US007312760B1

(12) United States Patent
Cheng

(10) Patent No.: US 7,312,760 B1
(45) Date of Patent: Dec. 25, 2007

(54) SOLID ANTENNA AND MANUFACTURING METHOD THEREOF

(75) Inventor: Shih-Chieh Cheng, Tainan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/588,266

(22) Filed: Oct. 27, 2006

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS 6,114,996 A * 9/2000 Nghiem ..... 343/700 MS 6,980,155 B2 * 12/2005 Lee et al. ..... 343/700 MS

* cited by examiner

*Primary Examiner*—Hoang V. Nguyen
(74) *Attorney, Agent, or Firm*—Birch, Stewart, Kolasch & Birch, LLP

(57) ABSTRACT

A solid antenna includes a first grounding portion, a second grounding portion, a first radiating portion, a second radiating portion, a first feeding portion and a second feeding portion. The second grounding portion is extended from one side of the first grounding portion. The first radiating portion is extended from the other side of the first grounding portion opposite to the one side of the first grounding portion. The second radiating portion is extended from the other side of the first grounding portion and has one side opposite to the other side of the first grounding portion. The first feeding portion is extended from the one side of the second radiating portion. The second feeding portion is extended from the first feeding portion and approximately parallel to the first radiating portion and the second radiating portion. In addition, the invention also discloses a method of manufacturing the solid antenna.

18 Claims, 15 Drawing Sheets

3

3

SOLID ANTENNA AND MANUFACTURING METHOD THEREOF

BACKGROUND OF THE INVENTION

1. Field of Invention

The invention relates to an antenna and a method of manufacturing the same, and, in particular, to a solid antenna and a method of manufacturing the same.

2. Related Art

The rapidly developed radio transmission has brought various products and technologies applied in the field of multi-band transmission, such that many new products have the performance of radio transmission to meet the consumer's requirement. The antenna is an important element for transmitting and receiving electromagnetic wave energy in the radio transmission system. If the antenna is lost, the radio transmission system cannot transmit and receive data. Thus, the antenna plays an indispensable role in the radio transmission system.

In the radio transmission system, the currently used frequency band specifications include IEEE 802.11, IEEE 802.15.1(bluetooth communication), and the like. IEEE 802.11 is further divided into the specifications of IEEE 802.11a, IEEE 802.11b and IEEE 802.11g. IEEE 802.11a is the specification corresponding to the frequency band of 5 GHz. IEEE 802.11b and IEEE 802.11g are the specifications corresponding to the frequency band of 2.4 GHz. IEEE 802.15.1 is also the specification corresponding to the frequency band of 2.4 GHz.

To meet the above-mentioned specifications, a solid antenna is often used. Referring to FIGS. 1A to 1E, the method of manufacturing the conventional solid antenna includes steps 1 to 8.

As shown in FIG. 1A, the first step is to provide a rectangular metal sheet 1 having long sides 11 and 11' parallel to each other, and short sides 12 and 12' parallel to each other.

As shown in FIG. 1B, the second step is to form a first slit 13 parallel to the short side 12 from the long side 11 of the rectangular metal sheet 1. Then, the third step is to form a second slit 14, which is parallel to the first slit 13 and has the length the same as that of the first slit 13, from the long side 11 of the rectangular metal sheet 1. A region formed between the first slit 13 and the second slit 14 is defined as a feeding portion 21. The fourth step is to form a third slit 15 connected with one end of the first slit 13 from the short side 12 of the rectangular metal sheet 1, and removes a rectangular metal sheet 16, which is a part of the rectangular metal sheet 1. The fifth step is to form a fourth slit 17 connected with one end of the second slit 14 from the other short side 12' parallel to the short side 12 of the rectangular metal sheet 1, and removes another rectangular metal sheet 18, which is another part of the rectangular metal sheet 1.

As shown in FIG. 1C, a region formed between the short side 12 of the metal sheet and a virtual line distant from the short side 12 by a distance D is defined as a grounding portion 22, and the region exclusive of the grounding portion 22 and the feeding portion 21 is defined as a radiating portion 23.

As shown in FIG. 1D, the sixth step is to bend the feeding portion 21 along a direction parallel to the other long side 11' by 90 degrees, and bends the grounding portion 22 along a direction parallel to the other short side 12' by 90 degrees. Then, the seventh step is to place a supporting block F between a printed circuit board 24 and the radiating portion 23 to make the printed circuit board 24 in parallel to the radiating portion 23. Accordingly, the feeding portion 21 and the grounding portion 22 can contact the printed circuit board 24 firmly. Thus, it is possible to prevent the difficult bonding process due to the skew of the printed circuit board 24 relative to the feeding portion 21 and the grounding portion 22.

As shown in FIG. 1E, the eighth step is to electrically connect the feeding portion 21 and the grounding portion 22 with the printed circuit board 24 by way of bonding, and to take out the supporting block F to complete the steps of manufacturing the solid antenna.

However, the metal waste products, which include the rectangular metal sheets 16 and 18 and are removed when the solid antenna is manufactured, occupy 20 to 35% of the overall rectangular metal sheet 1, as shown in FIG. 1B. In other words, the effectively used region of the rectangular metal sheet 1 only occupies 65 to 80%, and the other portions are wasted, thereby increasing the material cost. In addition, the feeding portion 21 and the grounding portion 22 are electrically connected with the printed circuit board 24 only through one end 211 of the feeding portion 21 and one end 221 of the grounding portion 22, as shown in FIG. 1D. Because the contact surface area is small, the feeding portion 21 and the grounding portion 22 tend to separate from the printed circuit board 24 during the manufacturing processes or in the subsequent usage. Thus, the product quality is influenced.

Therefore, it is an important subject of the invention to provide a solid antenna with enhanced connection between the printed circuit board and each of the feeding portion and the grounding portion, a reduced ratio of the metal waste product to the overall metal sheet, and a simplified manufacturing method thereof.

SUMMARY OF THE INVENTION

In view of the foregoing, the invention is to provide a solid antenna with enhanced metal sheet availability and a feeding portion and a grounding portion, which cannot be easily broken, and a simplified manufacturing method thereof.

To achieve the above, the invention discloses a solid antenna including a first radiating portion, a second radiating portion, a first grounding portion, a second grounding portion, a first feeding portion and a second feeding portion. The second grounding portion is extended from one side of the first grounding portion. The first radiating portion is extended from the other side of the first grounding portion opposite to the one side of the first grounding portion. The second radiating portion is extended from the other side of the first grounding portion and has one side opposite to the other side of the first grounding portion. The first feeding portion is extended from the one side of the second radiating portion. The second feeding portion is extended from the first feeding portion and approximately parallel to the first radiating portion and the second radiating portion.

In addition, the invention also discloses a method of manufacturing a solid antenna. The method includes the steps of: forming a slit on a metal sheet from a first side of the metal sheet to a second side of the metal sheet, wherein a first feeding portion and a second feeding portion are defined within a region, which is formed between the slit and one side of the metal sheet substantially parallel to the slit; bending the first feeding portion by a first angle along a direction parallel to the second side; bending the second feeding portion by a second angle relative to the first feeding portion along a first folding line parallel to the second side;

bending the metal sheet by a third angle along a second folding line, which is distant from the second side by a first distance; and bending the metal sheet by a fourth angle along a third folding line, which is distant from the first folding line by a second distance.

As mentioned above, a metal sheet may be used to directly form the solid antenna in this invention. In other words, the effectively used region of the metal sheet is 100%, so that the metal sheet availability is higher than the prior art availability ranging from 65 to 80%. In addition, the solid antenna of the invention has the second grounding portion and the second feeding portion respectively opposite to the first radiating portion and the second radiating portion. In this case, the second grounding portion and the second feeding portion may be firmly electrically connected with the substrate in the subsequent process of electrical connection with the substrate. Compared to the prior art, which only utilizes one end of the feeding portion and one end of the grounding portion to be electrically connected with the printed circuit board, the larger contact surface area between the substrate and each of the second grounding portion and the second feeding portion is formed. Thus, the second feeding portion and the second grounding portion may be firmly electrically connected with the substrate without using the prior art supporting block, and the manufacturing processes may be simplified. Furthermore, because the larger contact surface area between the substrate and each of the second grounding portion and the second feeding portion is formed in this invention, the connection between the substrate and each of the second grounding portion and the second feeding portion may be enhanced. Thus, the substrate cannot be easily separated from the second grounding portion and the second feeding portion, and the product quality may be enhanced in the subsequent manufacturing process or when the product is used subsequently.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2:
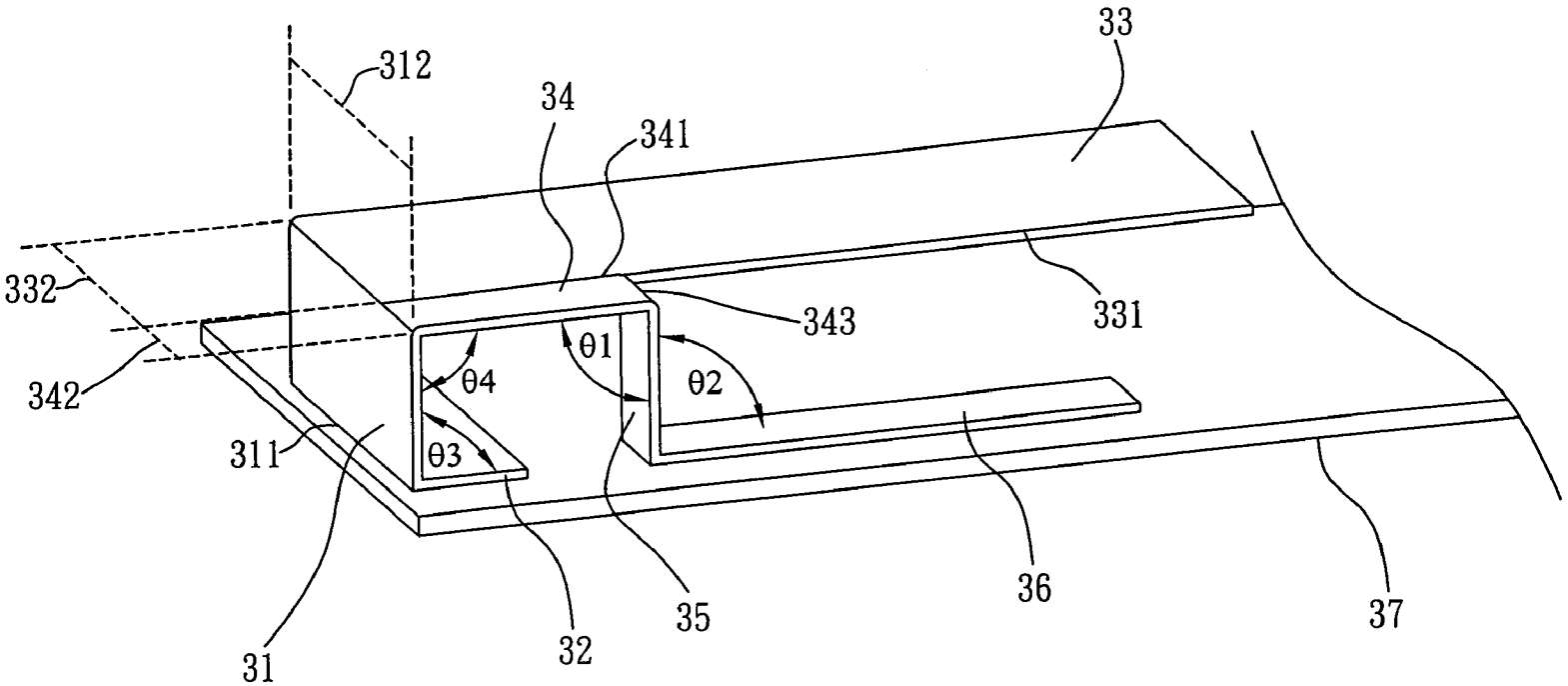
FIG. 2 is a pictorial view showing a solid antenna according to a first embodiment of the invention.

Referring to FIG. 2, a solid antenna 3 according to the first embodiment of the invention includes a first grounding portion 31, a second grounding portion 32, a first radiating portion 33, a second radiating portion 34, a first feeding portion 35 and a second feeding portion 36.

The second grounding portion 32 is extended from one side 311 of the first grounding portion 31. The shapes of the first grounding portion 31 and the second grounding portion 32 may vary according to the actual needs. In this embodiment, each of the first grounding portion 31 and the second grounding portion 32 is a rectangular sheet.

The first radiating portion 33 is extended from the other side 312 of the first grounding portion 31 opposite to the one side 311 of the first grounding portion 31, and the first radiating portion 33 has a first side 331 and a second side 332. The second side 332 of the first radiating portion 33 is extended from the other side 312 of the first grounding portion 31. In addition, the shape of the first radiating portion 33 may vary according to the actual requirement. In this embodiment, the first radiating portion 33 is a rectangular sheet.

The second radiating portion 34 is extended from the other side 312 of the first grounding portion 31, and the second radiating portion 34 has a third side 341, a fourth side 342 and one side 343 opposite to the other side 312 of the first grounding portion 31. The fourth side 342 of the second radiating portion 34 is extended from the other side 312 of the first grounding portion 31. In this embodiment, the second side 332 of the first radiating portion 33 is connected with the fourth side 342 of the second radiating portion 34. In addition, the length of the fourth side 342 of the second radiating portion 34 is shorter than the length of the second side 332 of the first radiating portion 33. Furthermore, the second side 332 of the first radiating portion 33 and the fourth side 342 of the second radiating portion 34 form an angle of 180 degrees. That is, the second side 332 of the first radiating portion 33 and the fourth side 342 of the second radiating portion 34 are located on the same plane.

In addition, the third side 341 of the second radiating portion 34 is disposed along the first side 331 of the first radiating portion 33. The shape of the second radiating portion 34 may also vary according to the actual requirement. In this embodiment, the second radiating portion 34 is also a rectangular sheet. In addition, the length of the third side 341 of the second radiating portion 34 is shorter than the length of the first side 331 of the first radiating portion 33 such that the first radiating portion 33 and the second radiating portion 34 form an approximately L-shaped piece.

In addition, the third side 341 of the second radiating portion 34 in this embodiment is a portion of the first side 331 of the first radiating portion 33. In other words, the first radiating portion 33 and the second radiating portion 34 are integrally formed.

The first feeding portion 35 is extended from the one side 343 of the second radiating portion 34 and is electrically connected with the second feeding portion 36. The shape of the first feeding portion 35 may vary according to the actual requirement. In this embodiment, the first feeding portion 35 is a rectangular sheet.

Figure 3:
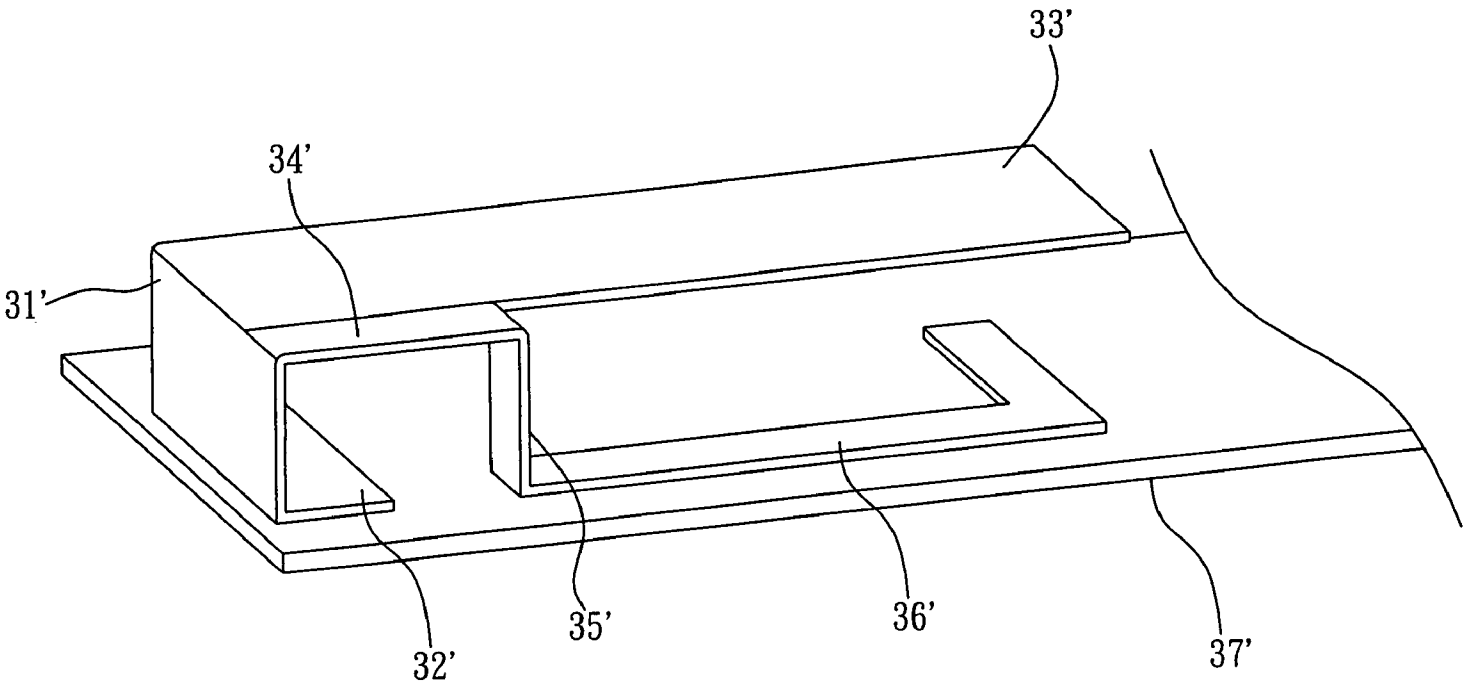
FIG. 3 is a pictorial view showing another solid antenna according to a second embodiment of the invention.
Figure 4:
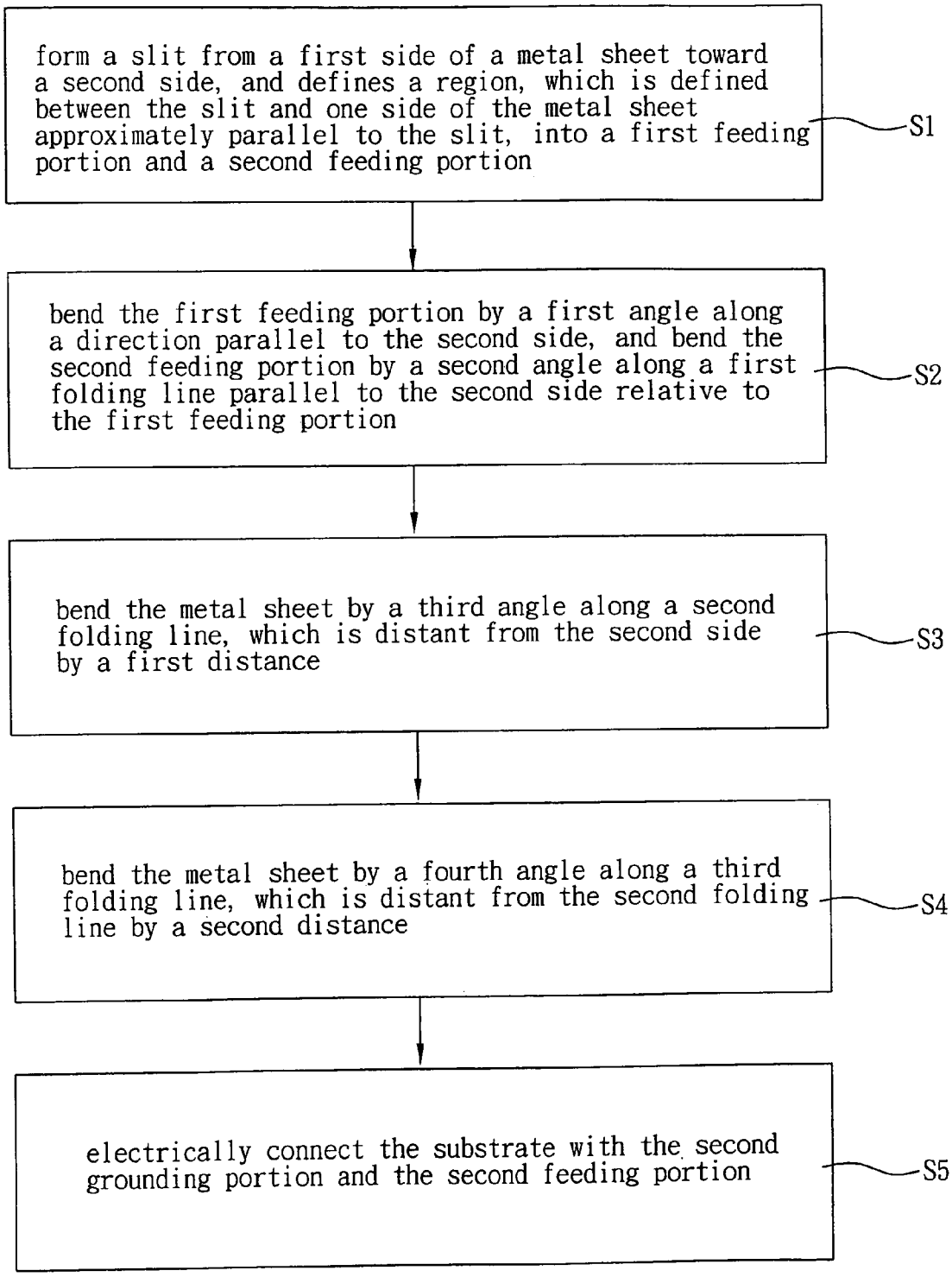
FIG. 4 is a flow chart showing a method of manufacturing the solid antenna of the first and second embodiments.

The second feeding portion 36 is extended from the first feeding portion 35 and approximately parallel to the first radiating portion 33 and the second radiating portion 34. The shape of the second feeding portion 36 may vary according to the actual requirement. For example, the second feeding portion 36 is a rectangular sheet. Alternatively, the second feeding portion 36' is an L-shape sheet, as shown in FIG. 3.

As shown in FIG. 2, the first feeding portion 35 and the second radiating portion 34 in this embodiment form a first angle 1, and the second feeding portion 36 and the first feeding portion 35 form a second angle 2. The sum of the second angle 2 and the first angle 1 is smaller than 225 degrees. In this embodiment, each of the second angle 2 and the first angle 1 is 90 degrees. In addition, the second grounding portion 32 and the first grounding portion 31 form a third angle 3, and a fourth angle 4 is formed between the first grounding portion 31 and each of the first radiating portion 33 and the second radiating portion 34. The sum of the fourth angle 4 and the third angle 3 is smaller than 180 degrees. In this embodiment, each of the third angle 3 and the fourth angle 4 is equal to 90 degrees.

Furthermore, the first grounding portion 31, the second grounding portion 32, the first radiating portion 33, the second radiating portion 34, the first feeding portion 35 and the second feeding portion 36 are made of metal and are integrally formed in this embodiment.

In addition, the solid antenna 3 further includes a substrate 37, which is disposed opposite to the first radiating portion 33 and the second radiating portion 34 and electrically connected with the second grounding portion 32 and the second feeding portion 36. In this embodiment, the substrate 37 is approximately parallel to the first radiating portion 33 and the second radiating portion 34. In addition, the substrate 37 in this embodiment may be a printed circuit board made of a BT resin (Bismaleimide-triazine resin) or a fiberglass reinforced epoxy resin (FR4), or a flexible film substrate made of polyimide.

It is to be noted that the solid antenna 3 may operate under different frequency bands including the frequency band with the specification of DECT, GSM, GPRS or IEEE 802.11 or other frequently used frequency bands according to the actual design, in which the first radiating portion 33 and the second radiating portion 34 are designed into various shapes and patterns. Of course, the antenna 3 may also be configured to operate in the dual-band mode or multi-band mode according to the actual requirement, and detailed descriptions thereof will be omitted.

Figure 1A:
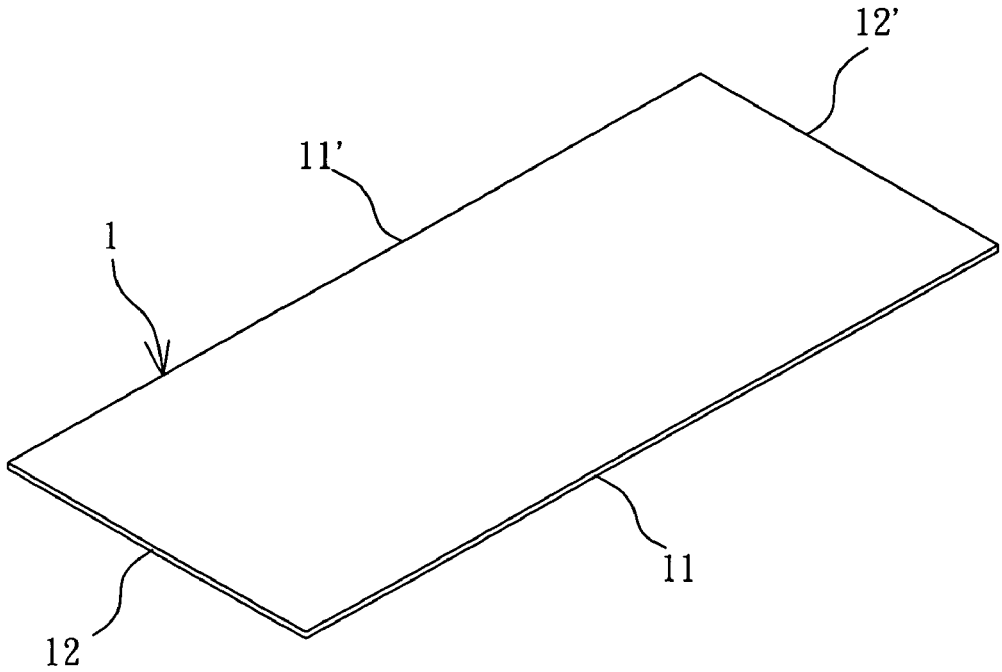
FIG. 1A (PRIOR ART)
FIGS. 1A to 1E show a conventional method of manufacturing a solid antenna.
Figure 1B:
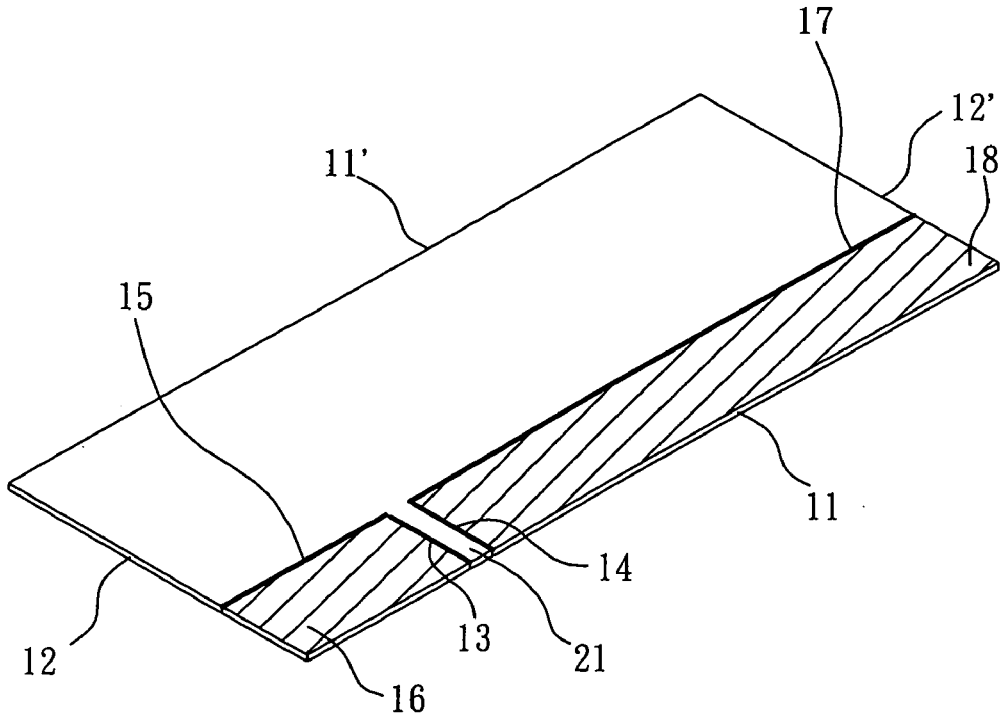
FIG. 1B (PRIOR ART)
Figure 1C:
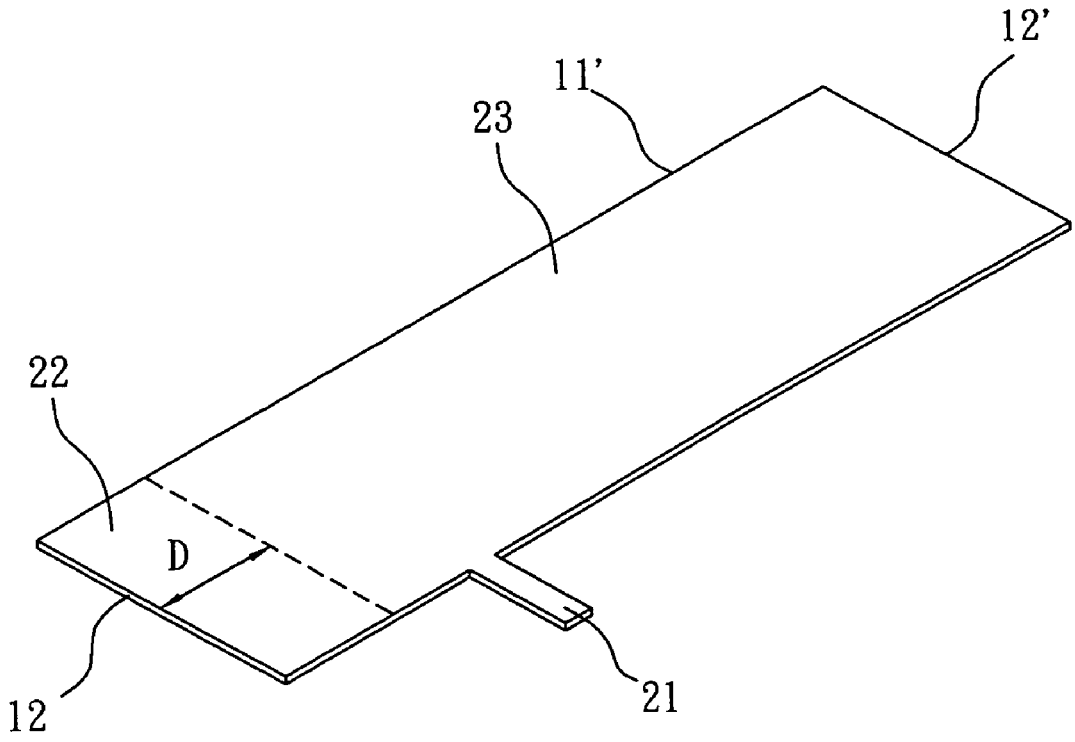
FIG. 1C (PRIOR ART)
Figure 1D:
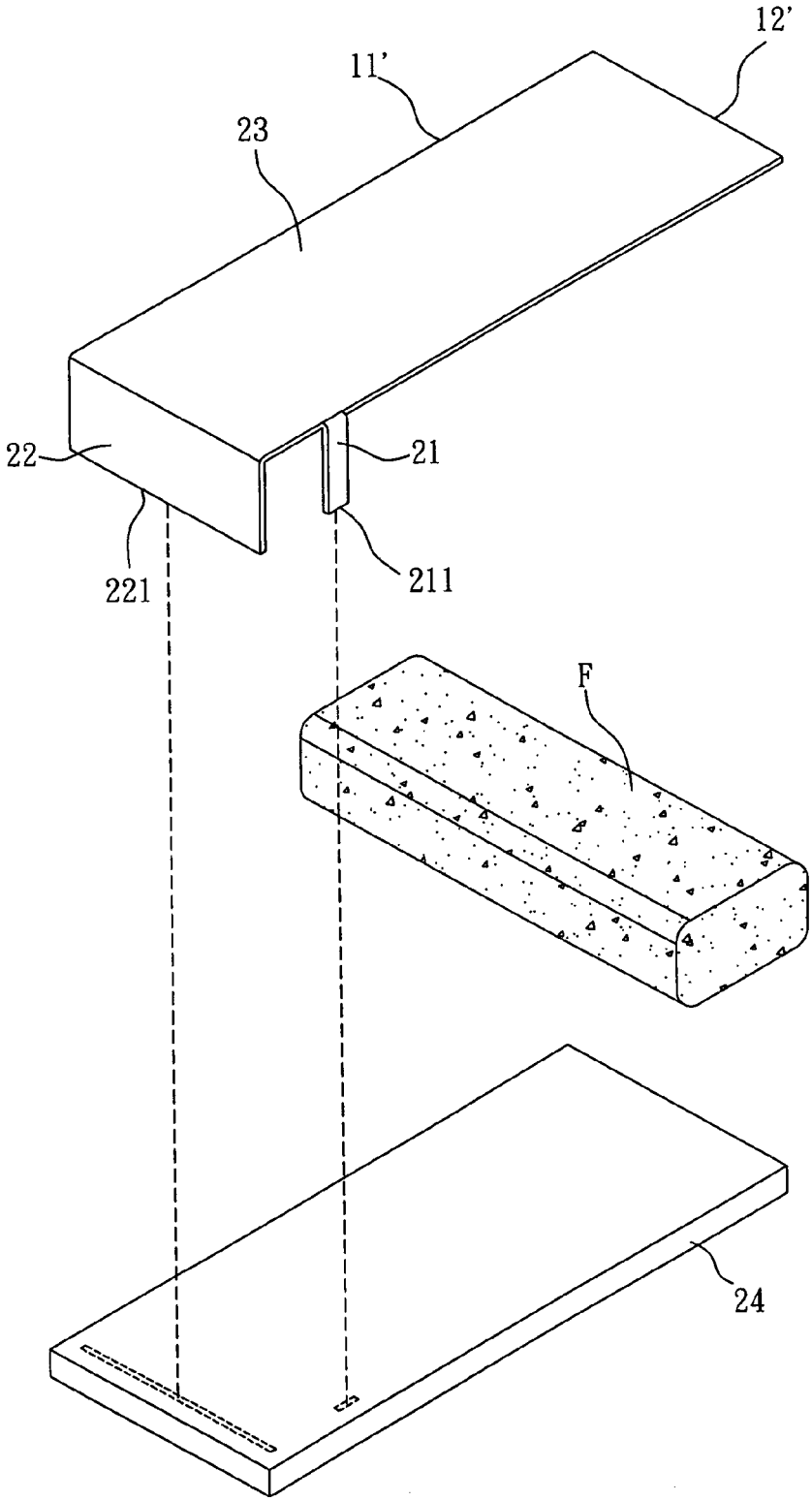
FIG. 1D (PRIOR ART)
Figure 1E:
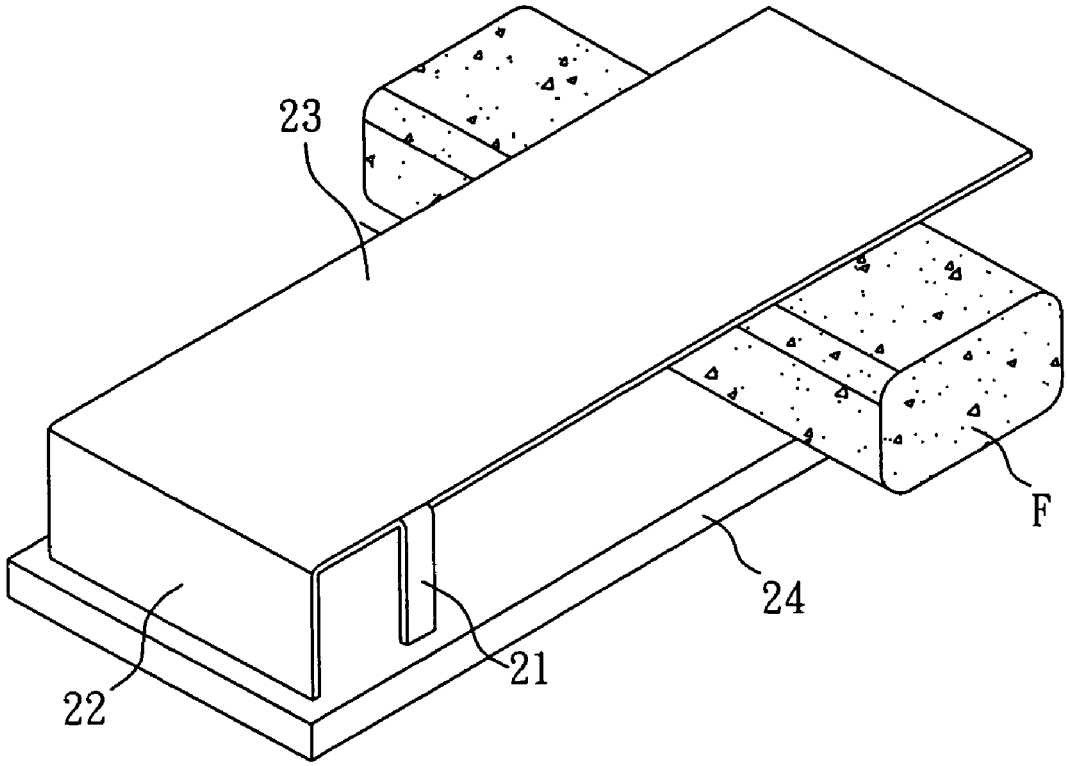
FIG. 1E (PRIOR ART)

Accordingly, the solid antenna 3 is electrically connected with the substrate 37 through the second grounding portion 32 and the second feeding portion 36. Compared to the prior art, in which the antenna is electrically connected with the printed circuit board 24 only through one end 211 of the feeding portion 21 and one end 221 of the grounding portion 22 (see FIG. 1D), a larger contact surface area between the substrate 37 and each of the second grounding portion 32 and the second feeding portion 36 may be obtained in this invention. Thus, each of the second feeding portion 36 and the second grounding portion 32 may be firmly electrically connected with the substrate 37 without the prior art supporting block F, and the manufacturing processes may be simplified. Furthermore, because the larger contact surface area between the substrate 37 and each of the second grounding portion 32 and the second feeding portion 36 of the invention is formed, the connection between the substrate 37 and each of the second grounding portion 32 and the second feeding portion 36 may be enhanced. Thus, each of the second grounding portion 32 and the second feeding portion 36 cannot be easily separated from the substrate 37 in the subsequent manufacturing processes or during the subsequent product usage, and the product quality may be enhanced.

The method of manufacturing the solid antenna of the first embodiment will be described with reference to FIG. 4 and FIGS. 5A to 5E, wherein FIGS. 5A to 5E show the steps of manufacturing the solid antenna.

Figure 5A:
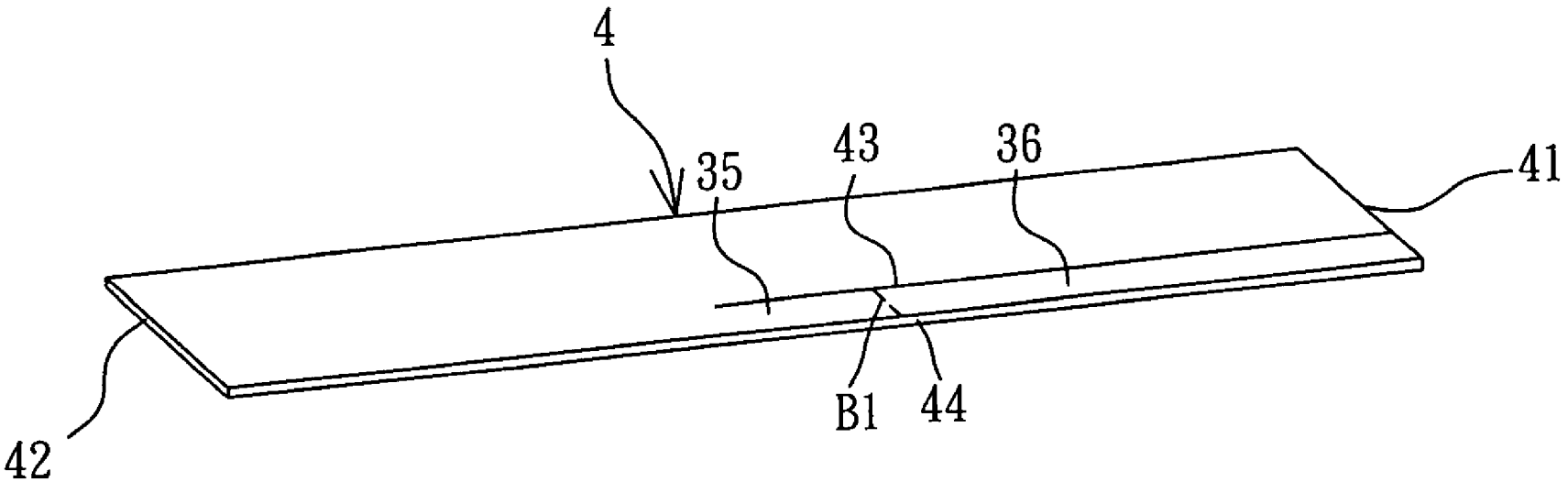
FIGS. 5A to 5E show the method of manufacturing the solid antenna according to the first embodiment of the invention.

As shown in FIG. 5A, step S1 forms a slit 43 from a first side 41 of a metal sheet 4 toward a second side 42, and defines a region, which is defined between the slit 43 and one side 44 of the metal sheet 4 approximately parallel to the slit 43, into a first feeding portion 35 and a second feeding portion 36. The first side 41 of the metal sheet 4 is disposed opposite to the second side 42, and the one side 44 of the metal sheet 4 is linear. In this embodiment, the first side 41 of the metal sheet 4 is parallel to the second side 42, and the one side 44 of the metal sheet 4 is connected with the first side 41 and the second side 42 of the metal sheet 4.

In addition, the slit 43 in this embodiment is also linear and parallel to the one side 44 of the metal sheet 4. The slit 43 may be formed by cutting or cropping or trimming, and the length of the slit 43 is shorter than the length of the one side 44 of the metal sheet 4.

Furthermore, step S1 also defines a first folding line B1 approximately parallel to the second side 42 of the metal sheet 4 in this embodiment. The region formed by the one side 44 near to the second side 42 of the metal sheet 4, the slit 43 and the first folding line B1 is defined as the first feeding portion 35. The region formed by the first side 41 of the metal sheet 4, the one side 44, the slit 43 and the first folding line B1 is defined as the second feeding portion 36.

Figure 5B:
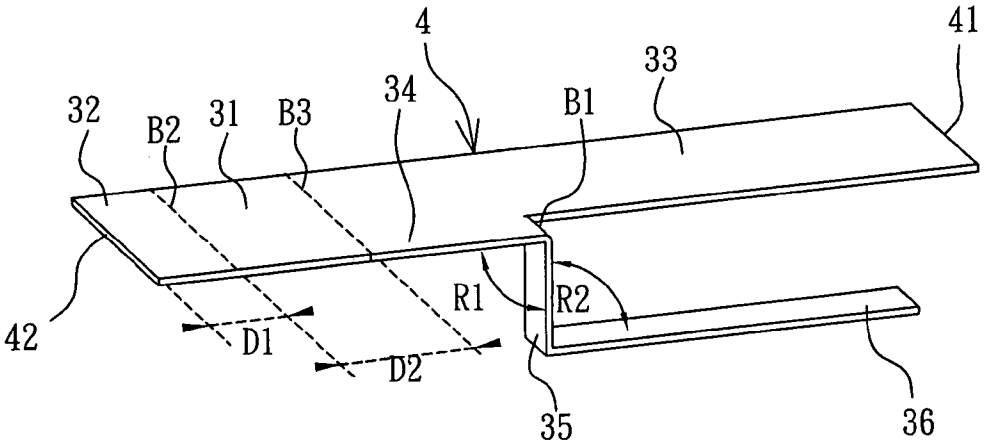

As shown in FIG. 5B, step S2 bends the first feeding portion 35 by a first angle R1 along a direction parallel to the second side 42, and bends the second feeding portion 36 by a second angle R2 along the first folding line B1 parallel to the second side 42 relative to the first feeding portion 35. The sum of the first angle R1 and the second angle R2 is smaller than 225 degrees. Each of the first angle R1 and the second angle R2 is equal to 90 degrees as an example in this embodiment.

Figure 5C:
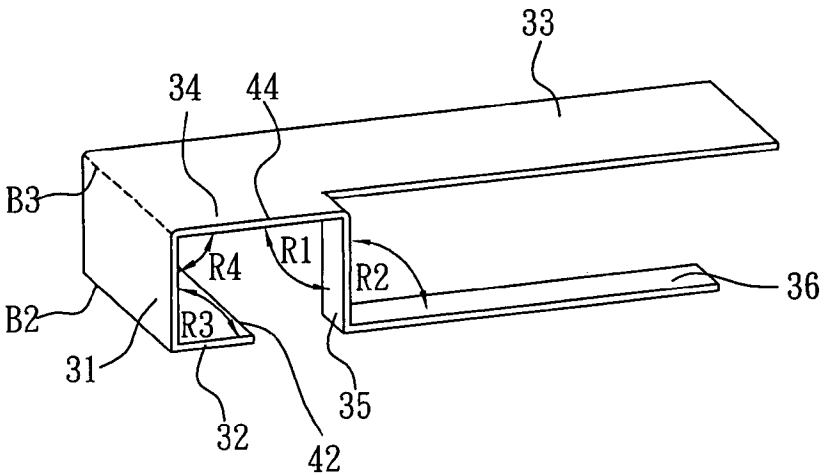

Next, as shown in FIGS. 5B and 5C, step S3 bends the metal sheet 4 by a third angle R3 along a second folding line B2, which is distant from the second side 42 by a first distance D1. Next, step S4 bends the metal sheet 4 by a fourth angle R4 along a third folding line B3, which is distant from the second folding line B2 by a second distance D2. The sum of the third angle R3 and the fourth angle R4 is smaller than 180 degrees. In this embodiment, each of the third angle R3 and the fourth angle R4 is equal to 90 degrees.

In addition, the region formed between the second folding line B2 and the third folding line B3 is defined as the first grounding portion 31. The region formed between the second side 42 and the second folding line B2 is defined as the second grounding portion 32. Then, the region formed by the one side 44 of the metal sheet 4, the first grounding portion 31 and the second feeding portion 36 is defined as the second radiating portion 34. Next, the region of the metal sheet 4 exclusive of the region formed by the first grounding portion 31, the second grounding portion 32, the second radiating portion 34, the first feeding portion 35 and the second feeding portion 36 is defined as the first radiating portion 33.

Figure 5D:
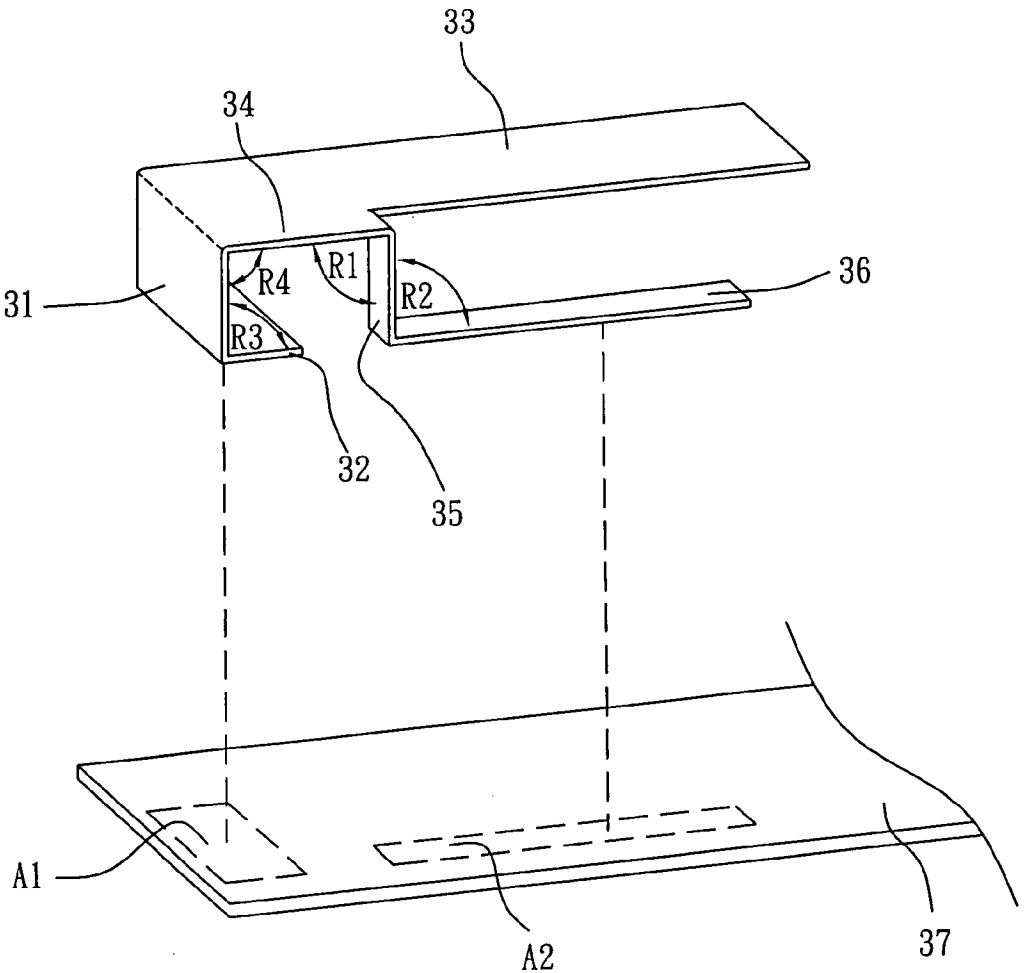
Figure 5E:
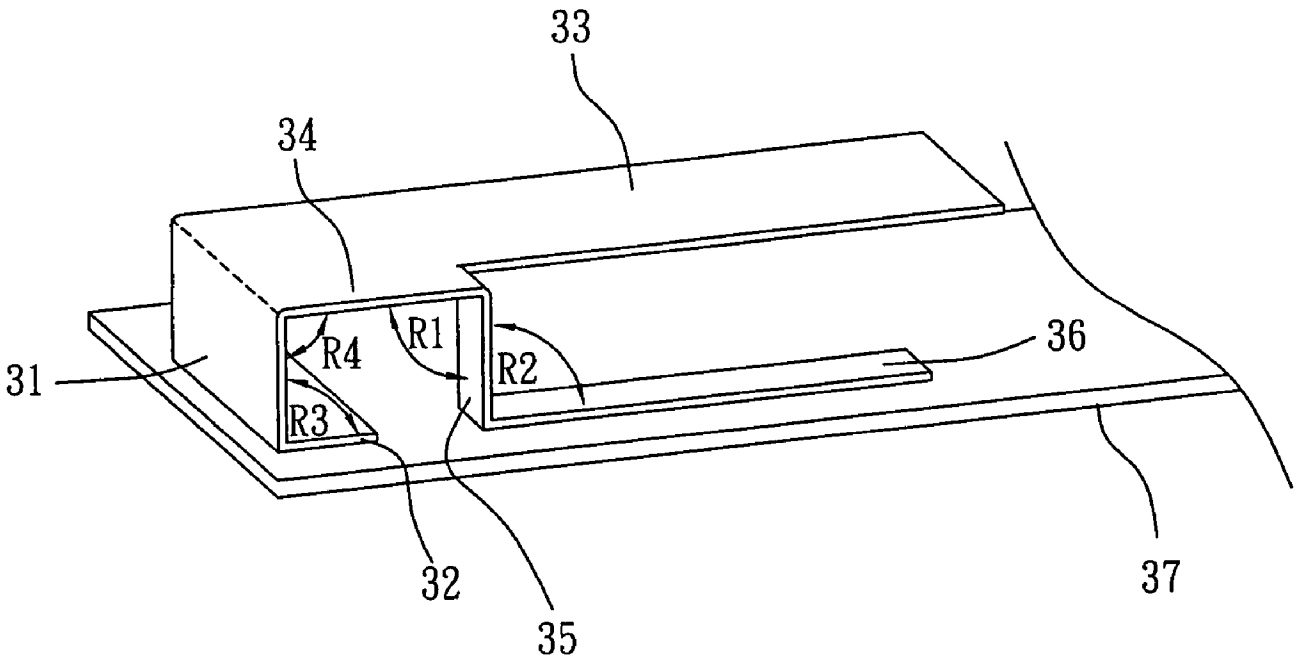

As shown in FIGS. 5D and 5E, step S5 electrically connects the substrate 37 with the second grounding portion 32 and the second feeding portion 36. The substrate 37 is opposite to the first radiating portion 33 and the second radiating portion 34 so that the manufacturing of the solid antenna is completed. In this embodiment, the substrate 37 is parallel to the first radiating portion 33 and the second radiating portion 34. The second grounding portion 32 and the second feeding portion 36 are respectively electrically connected with a first region A1 and a second region A2 of the substrate 37 by way of bonding or adhering with a conductive adhesive.

Compared to the prior art, the second grounding portion 32 and the second feeding portion 36 are electrically connected with the first region A1 and the second region A2 of the substrate 37 in the invention, respectively. The contact surface areas are obviously larger than the contact surface area between the printed circuit board 24 and the end 211 of the feeding portion 21 or the end 221 of the grounding portion 22 in the prior art. Thus, each of the second feeding portion 36 and the second grounding portion 32 may firmly contact the substrate 37 without using the supporting block F adopted in the prior art. Consequently, the manufacturing processes may be simplified. The connection between the substrate 37 and each of the second grounding portion 32 and the second feeding portion 36 may be enhanced. Therefore, the substrate 37 and each of the second grounding portion 32 and the second feeding portion 36 cannot be easily separated.

The method of manufacturing the solid antenna according to the second embodiment will be described with reference to FIG. 4 and FIGS. 6A to 6E, wherein FIGS. 6A to 6E show the steps of manufacturing the solid antenna.

Figure 6A:
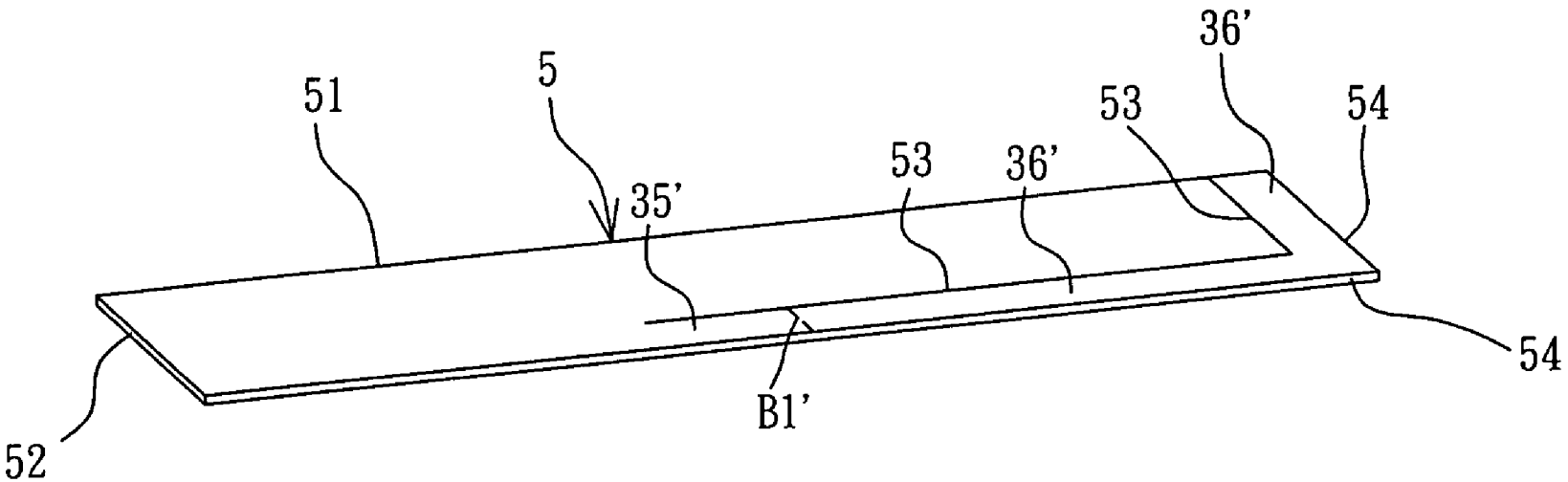
FIGS. 6A to 6E show the method of manufacturing the solid antenna according to the second embodiment of the invention.

As shown in FIG. 6A, step S1 forms a slit 53 from a first side 51 of a metal sheet 5 to a second side 52 of the metal sheet 5, and defines a region, which is formed by the slit 53 and one side 54 of the metal sheet 5 approximately parallel to the slit 53, as a first feeding portion 35' and a second feeding portion 36'. The first side 51 of the metal sheet 5 is adjacent to the second side 52 of the metal sheet 5.

In addition, because the first side 51 is adjacent to the second side 52 in this embodiment, the slit 53 has an L-shape and is approximately parallel to the one side 54 of the metal sheet 5. The slit 53 may be formed by way of cutting or trimming.

Furthermore, step S1 also defines a first folding line B1' approximately parallel to the second side 52 of the metal sheet 5 in this embodiment. The region formed by the one side 54 near to the second side 52 of the metal sheet 5, the slit 53 and the first folding line B1' is defined as the first feeding portion 35', while the region formed by the one side 54 of the metal sheet 5, the first side 51, the slit 53 and the first folding line B1 is defined as the second feeding portion 36'.

Figure 6B:
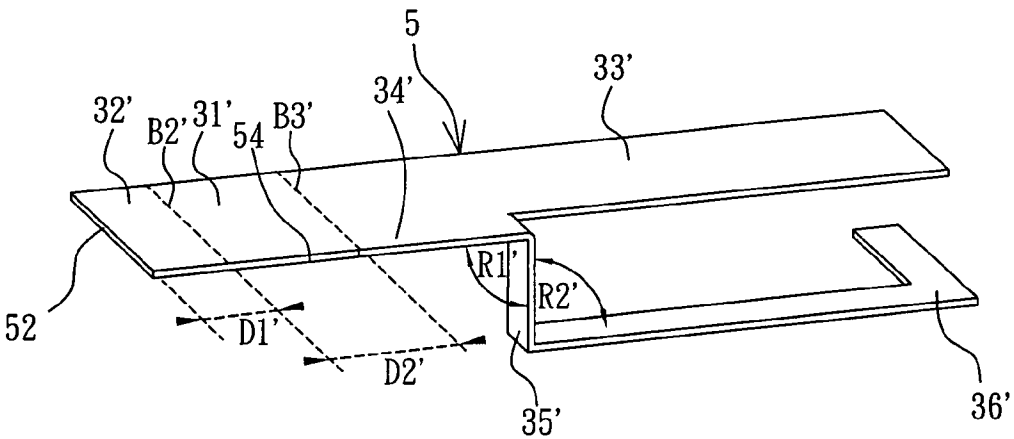

As shown in FIG. 6B, step S2 bends the first feeding portion 35' by a first angle R1' along the direction parallel to the second side 52, and bends the second feeding portion 36' by a second angle R2' along the first folding line B1' parallel to the second side 52 relative to the first feeding portion 35'. The sum of the first angle R1' and the second angle R2' is smaller than 225 degrees. In this embodiment, each of the first angle R1' and the second angle R2' is equal to 90 degrees.

Figure 6C:
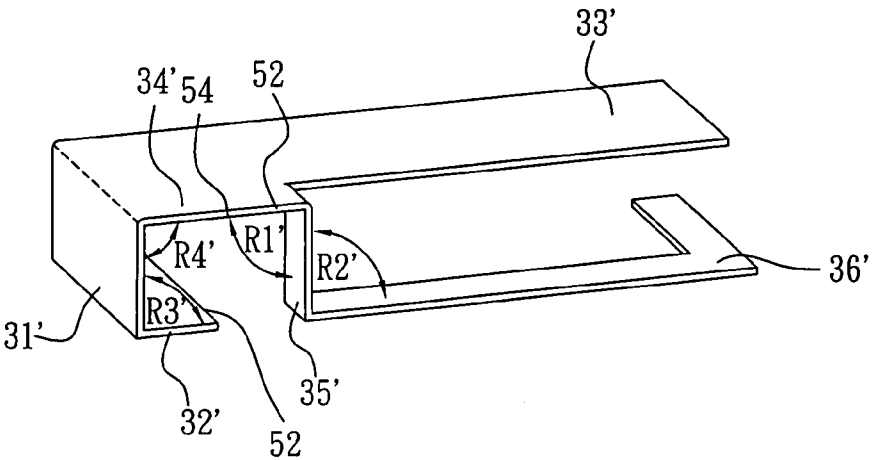

Next, as shown in FIGS. 6B and 6C, step S3 bends the metal sheet 5 by a third angle R3' along a second folding line B2', which is distant from the second side 52 by a first distance D1'. Next, step S4 bends the metal sheet 5 by a fourth angle R4' along a third folding line B3', which is distant from the second folding line B2' by a second distance D2'. The sum of the third angle R3' and the fourth angle R4' is smaller than 180 degrees. In this embodiment, each of the third angle R3' and the fourth angle R4' is equal to 90 degrees.

In addition, the region formed between the second folding line B2' and the third folding line B3' is defined as a first grounding portion 31', and the region formed between the second side 52 and the first folding line B1' is defined as a second grounding portion 32'. The region formed by the one side 54 of the metal sheet 5, the first grounding portion 31', and the second feeding portion 36' is defined as a second radiating portion 34'. Then, the region of the metal sheet 5 exclusive of the region formed by the first grounding portion 31', the second grounding portion 32', the second radiating portion 34', the first feeding portion 35' and the second feeding portion 36' is defined as a first radiating portion 33'.

Figure 6D:
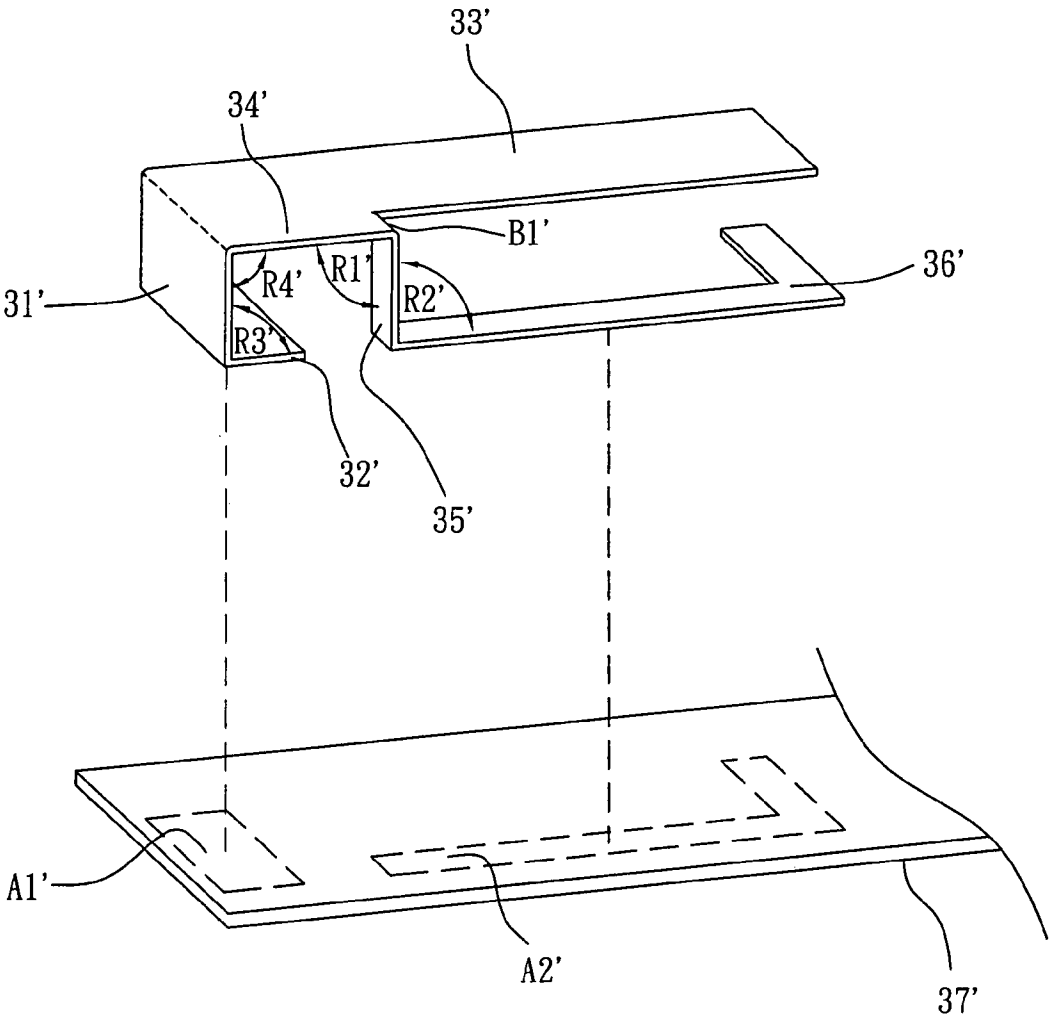
Figure 6E:
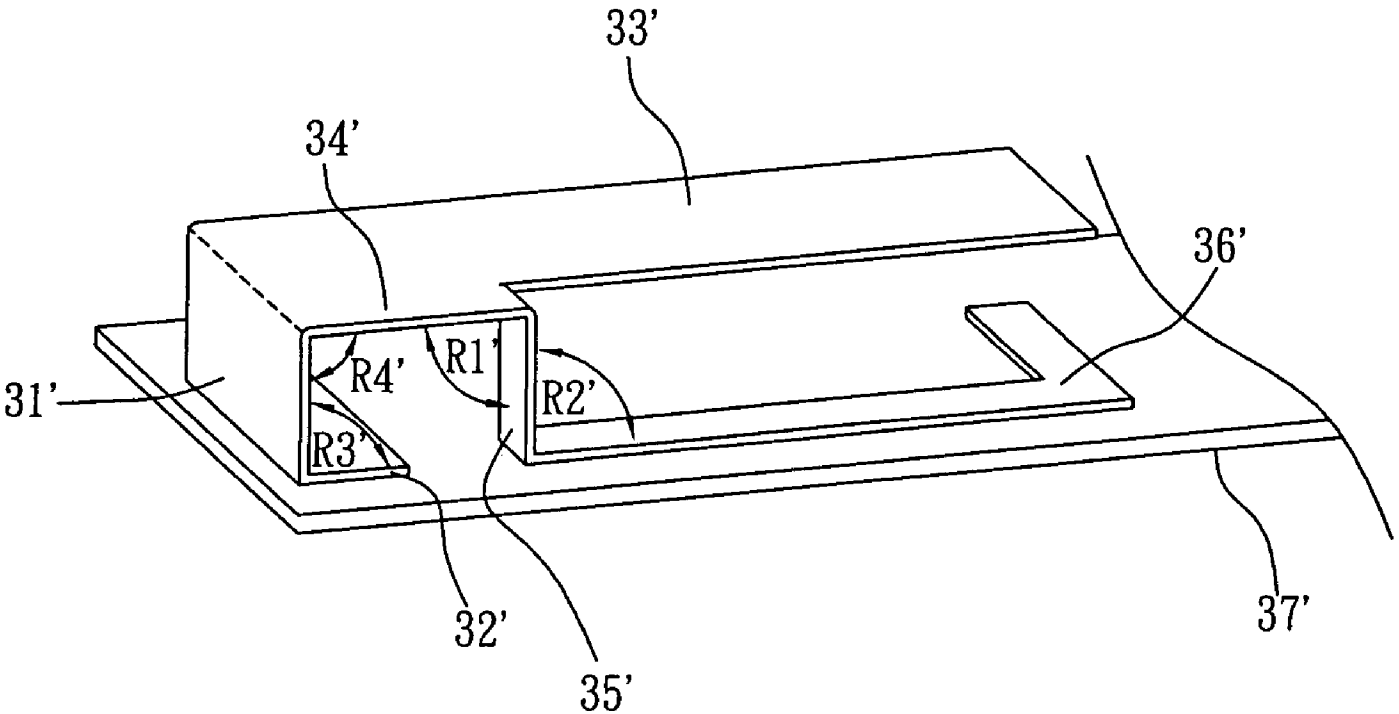

As shown in FIGS. 6D and 6E, step S5 electrically connects the substrate 37' with the second grounding portion 32' and the second feeding portion 36', and the substrate 37' is opposite to the first radiating portion 33' and the second radiating portion 34' so that the manufacturing of the solid antenna is completed. In this embodiment, the substrate 37' is parallel to the first radiating portion 33' and the second radiating portion 34'. The second grounding portion 32' and the second feeding portion 36' are respectively electrically connected with a first region A1' and a second region A2' of the substrate 37' by way of bonding or using a conductive adhesive.

Compared to the prior art, the second grounding portion 32' and the second feeding portion 36' are electrically connected with the first region A1' and the second region A2' of the substrate 37' in the invention, respectively. Besides, the contact surface areas are obviously larger than the contact surface area between the printed circuit board 24 and the one end 211 of the feeding portion 21 or the one end 221 of the grounding portion 22 in the prior art. Thus, each of the second feeding portion 36' and the second grounding portion 32' may firmly contact the substrate 37' without using the supporting block F adopted in the prior art. Consequently, the manufacturing processes may be simplified, and the connection between the substrate 37' and each of the second grounding portion 32' and the second feeding portion 36' may be enhanced. Therefore, the substrate 37' and each of the second grounding portion 32' and the second feeding portion 36' cannot be easily separated.

In summary, a metal sheet may be used to directly form the solid antenna in this invention. In other words, the effectively used region of the metal sheet is 100%, so that the metal sheet availability is higher than the prior art availability ranging from 65 to 80%. In addition, the solid antenna of the invention has the second grounding portion and the second feeding portion respectively opposite to the first radiating portion and the second radiating portion. In this case, the second grounding portion and the second feeding portion may be firmly electrically connected with the substrate in the subsequent process of electrical connection with the substrate. Compared to the prior art, which only utilizes one end of the feeding portion and one end of the grounding portion to be electrically connected with the printed circuit board, the larger contact surface area between the substrate and each of the second grounding portion and the second feeding portion is formed. Thus, the second feeding portion and the second grounding portion may be firmly electrically connected with the substrate without using the prior art supporting block, and the manufacturing processes may be simplified. Furthermore, because the larger contact surface area between the substrate and each of the second grounding portion and the second feeding portion is formed in this invention, the connection between the substrate and each of the second grounding portion and the second feeding portion may be enhanced. Thus, the substrate cannot be easily separated from the second grounding portion and the second feeding portion, and the product quality may be enhanced in the subsequent manufacturing process or when the product is used subsequently.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A solid antenna, comprising:

a first grounding portion;

a second grounding portion extended from one side of the first grounding portion;

a first radiating portion extended from the other side of the first grounding portion opposite to the one side of the first grounding portion;

a second radiating portion extended from the other side of the first grounding portion and having one side opposite to the other side of the first grounding portion;

a first feeding portion extended from the one side of the second radiating portion; and a second feeding portion extended from the first feeding portion and approximately parallel to the first radiating portion and the second radiating portion.

2. The antenna according to claim 1, wherein each of the first radiating portion, the second radiating portion, the first grounding portion, the second grounding portion, the first feeding portion and the second feeding portion has a rectangular shape.

3. The antenna according to claim 1, wherein the second feeding portion has an L-shape.

4. The antenna according to claim 1, wherein the first radiating portion has a first side, the second radiating portion has a third side, and the first side is disposed along the third side.

5. The antenna according to claim 1, wherein the first radiating portion has a second side, the second radiating portion has a fourth side, and the second side and the fourth side are disposed along the other side of the first grounding portion.

6. The antenna according to claim 5, wherein a length of the fourth side is shorter than a length of the second side.

7. The antenna according to claim 5, wherein the second side of the first radiating portion and the fourth side of the second radiating portion form an angle of 180 degrees.

8. The antenna according to claim 1, further comprising a substrate, wherein the second grounding portion and the second feeding portion are disposed on a surface of the substrate and electrically connected with the substrate.

9. The antenna according to claim 1 operating at frequency bands with the specifications of DECT, GSM, GPRS and IEEE 802.11.

10. The antenna according to claim 1, wherein the first grounding portion, the second grounding portion, the first radiating portion, the second radiating portion, the first feeding portion and the second feeding portion are integrally formed.

11. The antenna according to claim 1, wherein the first grounding portion, the second grounding portion, the first radiating portion, the second radiating portion, the first feeding portion and the second feeding portion are made of metal.

12. A method of manufacturing a solid antenna, the method comprising steps of:

forming a slit on a metal sheet from a first side of the metal sheet to a second side of the metal sheet, wherein a first feeding portion and a second feeding portion are defined within a region formed between the slit and one side of the metal sheet substantially parallel to the slit;

bending the first feeding portion by a first angle along a direction parallel to the second side, and bending the second feeding portion by a second angle relative to the first feeding portion along a first folding line parallel to the second side;

bending the metal sheet by a third angle along a second folding line, wherein the second folding line is distant from the second side by a first distance; and bending the metal sheet by a fourth angle along a third folding line, wherein the third folding line is distant from the first folding line by a second distance.

13. The method according to claim 12, wherein a region of the second folding line and the third folding line is defined as a first grounding portion, and a region of the second side of the metal sheet and the first folding line is defined as a second grounding portion.

14. The method according to claim 13, further comprising a step of:

electrically connecting the second grounding portion and the second feeding portion to a substrate.

15. The method according to claim 12, wherein the first side of the metal sheet is opposite to the second side of the metal sheet.

16. The method according to claim 15, wherein the slit is linear or L-shaped.

17. The method according to claim 12, wherein the first side of the metal sheet is adjacent to the second side.

18. The method according to claim 12, wherein a sum of the first angle and the second angle is smaller than 225 degrees.

* * * * *